US009837258B2

(12) United States Patent
Youngner

(10) Patent No.: US 9,837,258 B2
(45) Date of Patent: Dec. 5, 2017

(54) ION TRAP WITH VARIABLE PITCH ELECTRODES

(71) Applicant: Honeywell International Inc., Morristown, NJ (US)

(72) Inventor: Daniel Youngner, Maple Grove, MN (US)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 14/719,587

(22) Filed: May 22, 2015

(65) Prior Publication Data

US 2016/0343563 A1 Nov. 24, 2016

(51) Int. Cl.
*H01J 49/42* (2006.01)
*G21K 1/00* (2006.01)

(52) U.S. Cl.
CPC ..... *H01J 49/4255* (2013.01); *G21K 1/00* (2013.01)

(58) Field of Classification Search
USPC ..... 250/283
See application file for complete search history.

(56) References Cited

U.S. PATENT DOCUMENTS 5,206,506 A * 4/1993 Kirchner ..... G21K 1/003 250/281
6,111,250 A * 8/2000 Thomson ..... H01J 49/005 250/281
7,180,078 B2 * 2/2007 Pau ..... G21K 1/003 250/378
7,786,435 B2 * 8/2010 Whitehouse ..... H01J 49/062 250/287
8,969,798 B2 * 3/2015 Park ..... H01J 49/063 250/282
9,413,330 B2 * 8/2016 Shimizu ..... H03H 9/1452
2006/0169882 A1 8/2006 Pau et al.
2009/0294655 A1 * 12/2009 Ding ..... H01J 49/004 250/283

FOREIGN PATENT DOCUMENTS

EP 0884785 A2 12/1998
WO 2013063660 A1 5/2013
WO 2014195677 A1 12/2014

OTHER PUBLICATIONS

Extended Search Report from related European Patent Application No. 16159281, dated Oct. 13, 2016, 9 pp.
Exam Report from related European Patent Application No. 16159281, dated Jul. 3, 2017, 5 pp.

* cited by examiner

*Primary Examiner* — Phillip A Johnston
(74) *Attorney, Agent, or Firm* — Brooks, Cameron & Huebsch, PLLC

(57) ABSTRACT

Methods, apparatuses, and systems for design, fabrication, and use of an ion trap with variable pitch electrodes are described herein. One apparatus includes an ion trap and a plurality of variable pitch electrodes disposed on the ion trap. A respective electrode of the plurality of electrodes can have a first pitch in a first region of the trap and a second pitch in a second region of the trap.

16 Claims, 3 Drawing Sheets

ION TRAP WITH VARIABLE PITCH ELECTRODES

STATEMENT OF GOVERNMENT RIGHTS

This invention was made with Government support under contract: W911NF-12-1-0605, awarded by the U.S. Army. The Government has certain rights in this invention.

TECHNICAL FIELD

The present disclosure relates to methods, devices, and systems for positional control of ions in an ion trap.

BACKGROUND

An ion trap can use a combination of electrical and magnetic fields to capture one or more ions in a potential well. Ions can be trapped for a number of purposes, which may include mass spectrometry, research, and/or controlling quantum states, for example.

Ions can be transported along a path in some regions of an ion trap, and can have their motion restricted in other regions of an ion trap. As an example, electric and/or magnetic fields can be used to transport and/or capture ions (e.g., charged particles). Some ion traps make use of electrodes to transport and/or capture ions, for example, by providing static and/or oscillating electric fields that can interact with the ion.

It may be desirable to provide differing degrees of positional control to such ions as they move through different regions of an ion trap; however, providing differing degrees of positional control over ions in an ion trap can be problematic using conventional methods, which can employ electrodes of uniform pitch to provide positional control.

DETAILED DESCRIPTION

The embodiments of the present disclosure relate to methods, apparatuses, and systems for design, fabrication, and use of an ion trap with variable pitch electrodes. As described herein, different issues which can arise from the use of some previous approaches to ion trap technology can be overcome.

One such issue can arise from use of electrodes that are formed on uniform pitch in an ion trap. Forming electrodes on uniform pitch in an ion trap can limit positional control over ions in an ion trap, for example, by providing a uniform electric field that can interact with the ion. Stated differently, positional control of ions in an ion trap can be limited to a single degree of positional control over the ions if the ions are transported and/or positioned using electrodes that are formed on uniform pitch.

In the following detailed description, reference is made to the accompanying figures that form a part hereof. The figures show by way of illustration how one or more embodiments of the disclosure may be practiced.

The embodiments are described in sufficient detail to enable those of ordinary skill in the art to practice one or more embodiments of this disclosure. It is to be understood that other embodiments may be utilized and that process, electrical, and/or structural changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

It should be noted that although many of the figures provided herein provide visual views of example optical bench configurations and example alignments of optical fibers, the embodiments of the present disclosure can be accomplished by using different configurations, materials, and/or components. Further, as used herein, "a" or "a number of" something can refer to one or more such things. For example, "a number of optical components" can refer to one or more optical components.

Figure 1:
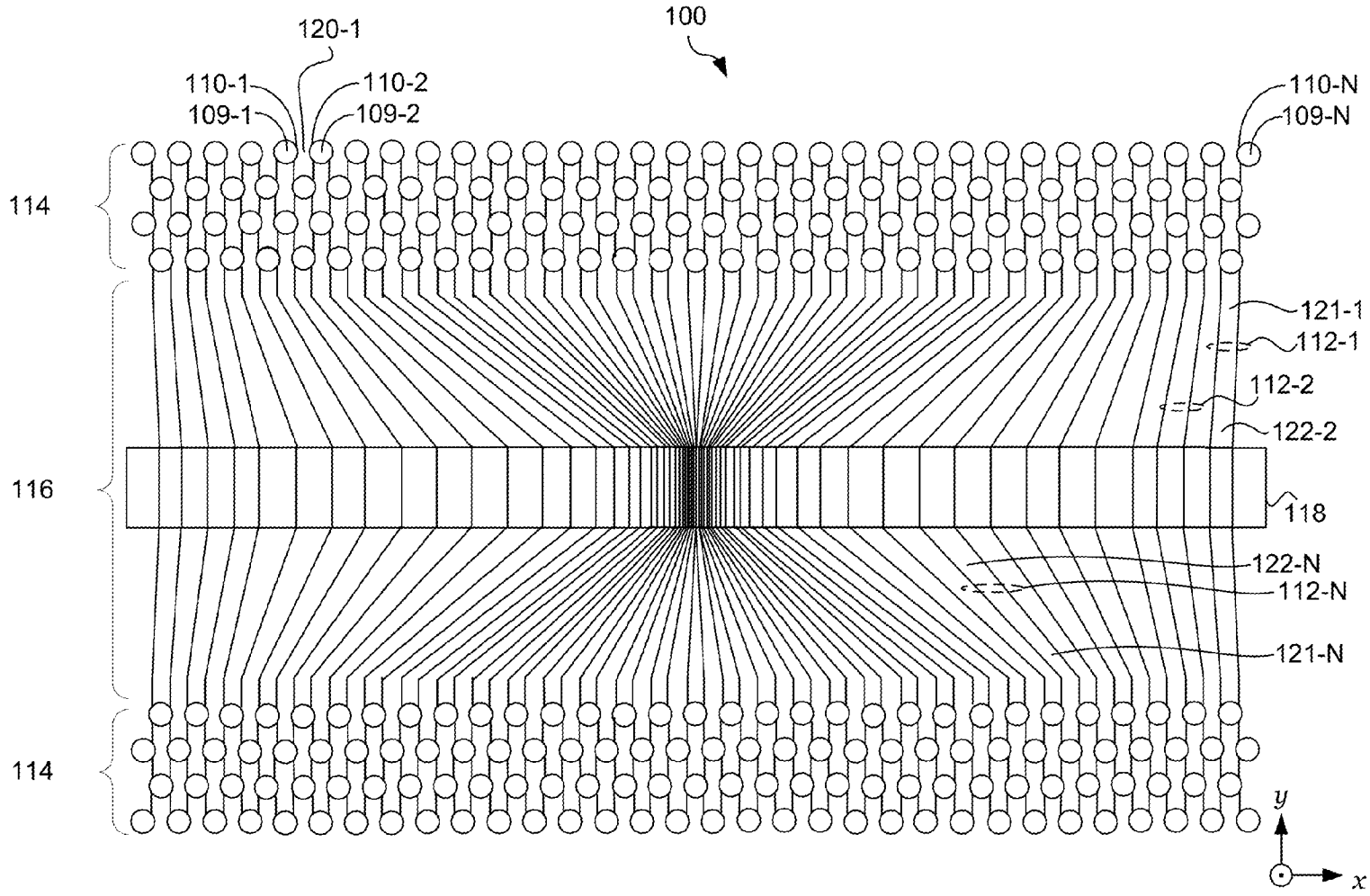
FIG. 1 provides an illustration of an example ion trap.

FIG. 1 provides an illustration of an example ion trap 100 according to the present disclosure. As illustrated in FIG. 1, the ion trap 100 can include a plurality of vias 109-1, 109-2, . . . , 109-N (referred to generally herein as "vias 109"). A plurality of capacitors 110-1, 110-2, . . . , 110-N (referred to generally herein as "capacitors 110") can be included and positioned such that a respective capacitor 110-1, for example radially encompasses a respective via 109-1, for example. The ion trap 100 can be fabricated using anisotropic and deep reactive ion (DRIE) etching techniques, among other suitable techniques.

The plurality of capacitors 110 can be formed on a first pitch 120-1. As used herein, "pitch" refers to a distance between various similar objects. For example, as illustrated in FIG. 1, a first capacitor (e.g., 110-1) can be formed adjacent to a second capacitor (e.g., 110-2), and the distance (e.g., first pitch 120-1) between the two capacitors in the x-direction is then the pitch on which the two capacitors 110-2, 110-2 are formed. As a further example, a pitch (e.g., 122-1) associated with an electrode (e.g., 112-1) can be a distance between the rails of the electrode.

In the example of FIG. 1, the ion trap 100 can include a first region 114 and a second region 116. In some embodiments, first region 114 can include a plurality of vias 109 and a plurality of capacitors 110. The second region 116 can include a plurality of electrodes 112-1, 112-1, . . . , 112-N (referred to generally herein as "electrodes 112"), and a control region 118.

In some embodiments, respective electrodes among the plurality of electrodes 112 can be formed on a pitch that is different from the first pitch 120. For example, electrode 112-2 can be formed on a second pitch 122-1 that is different from the first pitch 120-1. As a further example, electrodes 120-N can be formed on a pitch 122-N that is different than the first pitch 120-1. Examples are not so limited; however, and respective electrodes of the plurality of electrodes 112 can be formed at a pitch that is different both from the first pitch 120-1 and a pitch (e.g., 122-1) on which a different respective electrode is formed. That is, electrode 112-N can be formed on a pitch 122-N that is different than the first pitch 120-1 and different from pitch 122-1, for example.

In some embodiments, the pitch of respective electrodes of the plurality of electrodes 112 can vary along a length of a respective electrode (e.g., 112-1). For example, in the first region 114, an electrode 112-1 can have a pitch that is the same as the first pitch 120-1, and a pitch that is different than the first pitch 120-1 in the second region 116. In some embodiments, the rails of a respective electrode 112 can taper continuously from the first pitch to the second pitch.

In some embodiments, an apparatus can include an ion trap 100 and a plurality of variable pitch electrodes 112 disposed on the ion trap 100. A respective electrode (e.g., 112-1) of the plurality of electrodes 112 can have a first pitch 121-1 in a first region 114 of the ion trap 100 and a second pitch 122-1 in a second region 116 of the ion trap 100.

A plurality of capacitors 110 can be disposed in the first region 114. In some embodiments, a respective capacitor (e.g., 110-1) of the plurality of capacitors 110 can be formed on the first pitch 120-1. The capacitors 110 can be trench capacitors, for example.

In some embodiments, the first pitch can be between 50 microns and 70 microns, and the second pitch can be less than 50 microns. Embodiments are not so limited; however, and the second pitch can be greater than 70 microns, for example.

As discussed in further detail in connection with FIG. 2, providing electrodes 112 on a different pitch (e.g., 121-1, . . . , 121-N, 122-1, . . . , 122-N) than a pitch 120-1 associated with the capacitors 110 can allow for ions to be transported with varying degrees of positional control in the ion trap 100. For example, coarse positional control over ions in the ion trap 100 can be provided in a first region 114, while fine positional control over ions in the ion trap 100 can be provided in a second region 116.

Figure 2:
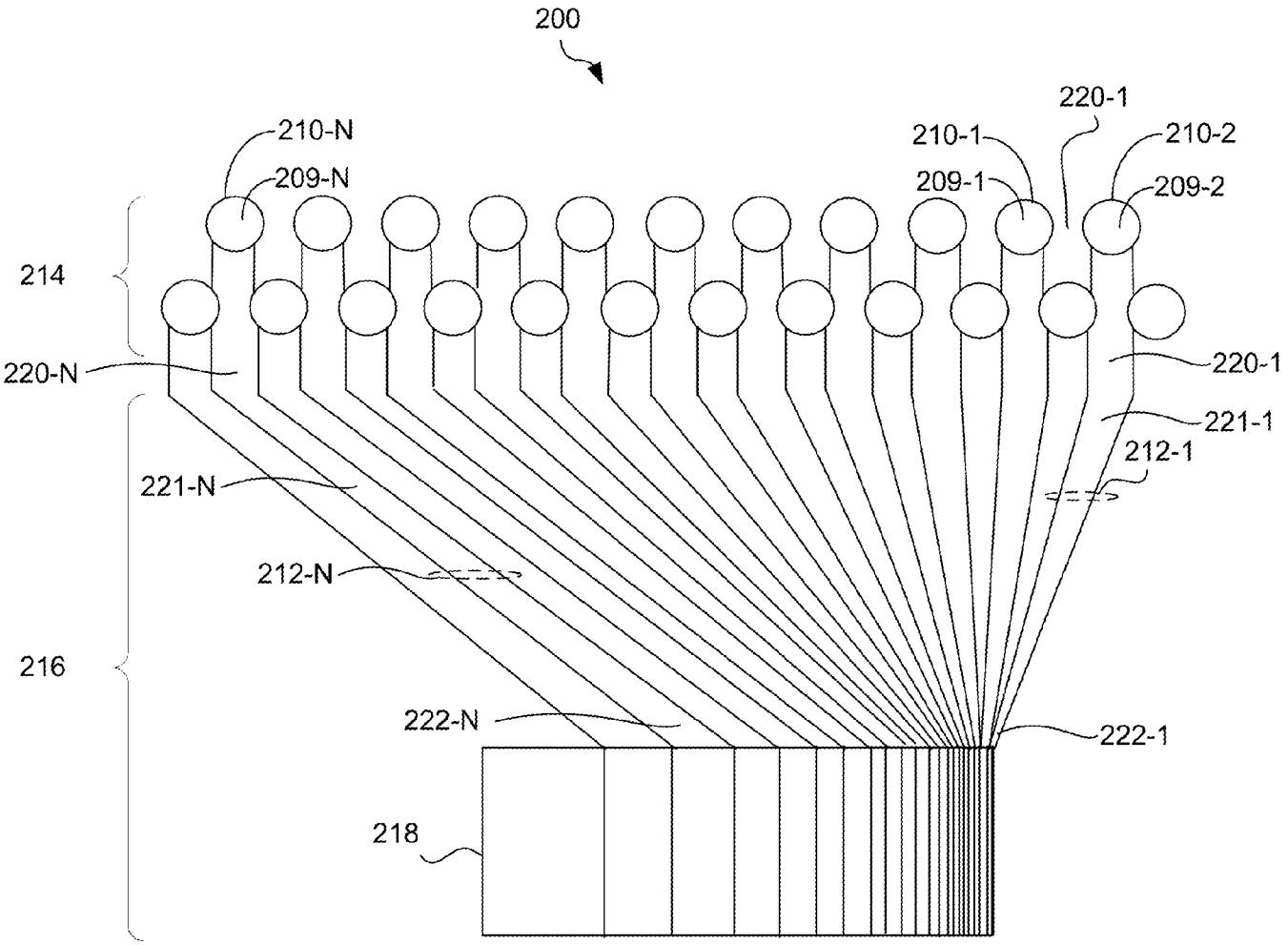
FIG. 2 illustrates a portion of an example ion trap.

FIG. 2 illustrates a portion of an example ion trap 200 according to the present disclosure. In some embodiments, a pitch on which a respective electrode (e.g., 212-1) is formed can vary along a length of the respective electrode (e.g., 212-1). That is, the pitch of a respective electrode (e.g., 212-1) can be tapered such that a pitch at one end of the electrode (e.g., 212-1) is different than a pitch at the opposite end of the electrode (e.g., 212-1). For example, with respect to electrode 212-1, pitch 221-1 can be different than pitch 220-1, and can also be different than pitch 222-1.

In some embodiments, the capacitors 210 can be trench capacitors. As an example, trench capacitors 210 can be formed such that a trench region of at least one of the plurality of capacitors 210 extends to a depth of between 200 and 400 microns from the surface of the ion trap. In some embodiments, at least one of the plurality of capacitors 210 can have a capacitance between 50 and 250 picofarads. For example, at least one of the capacitors 210 can have a capacitance of 100 picofarads.

In some embodiments, an ion trap apparatus can include an apparatus body, a plurality of vias 209 disposed on the body, and a plurality of electrodes 212. Each respective electrode (e.g., 212-1) can be electrically coupled to a respective capacitor (e.g., 210-2). A first pitch 220-1 of each respective electrode 212 can be the same as a pitch 220-1 of the respective capacitor (e.g., 210-2) in a first region 214 of the body, and a second pitch (e.g., 222-1) of each respective electrode 212 can be different than the pitch 220 of the respective capacitor 210 in a second region 216 of the body. Advantageously, this can allow for variable positional control of an ion in the different regions. For example, coarse positional control can be provided in first region 214, and fine positional control can be provided in second region 216 and in the control region 218.

In some embodiments, the pitch of a respective electrode (e.g., 212-1) can be tapered from the first pitch 220-1 to the second pitch 222-1 such that a distance between the rails of the respective electrode (e.g., 212-1) changes as a distance from the respective capacitor (e.g., 210-2) changes.

An example method 330 of fabrication for one or more embodiments contained herein is presented below. In some embodiments, an ion trap can be formed from a plurality of alternating metal and dielectric layers that can be formed together in a sequential order. For instance, anisotropic etching or deep reactive ion etching (DRIE) can be used to form portions of the ion trap. Anisotropic etching and DRIE are different etching techniques in the context of device fabrication.

Figure 3:
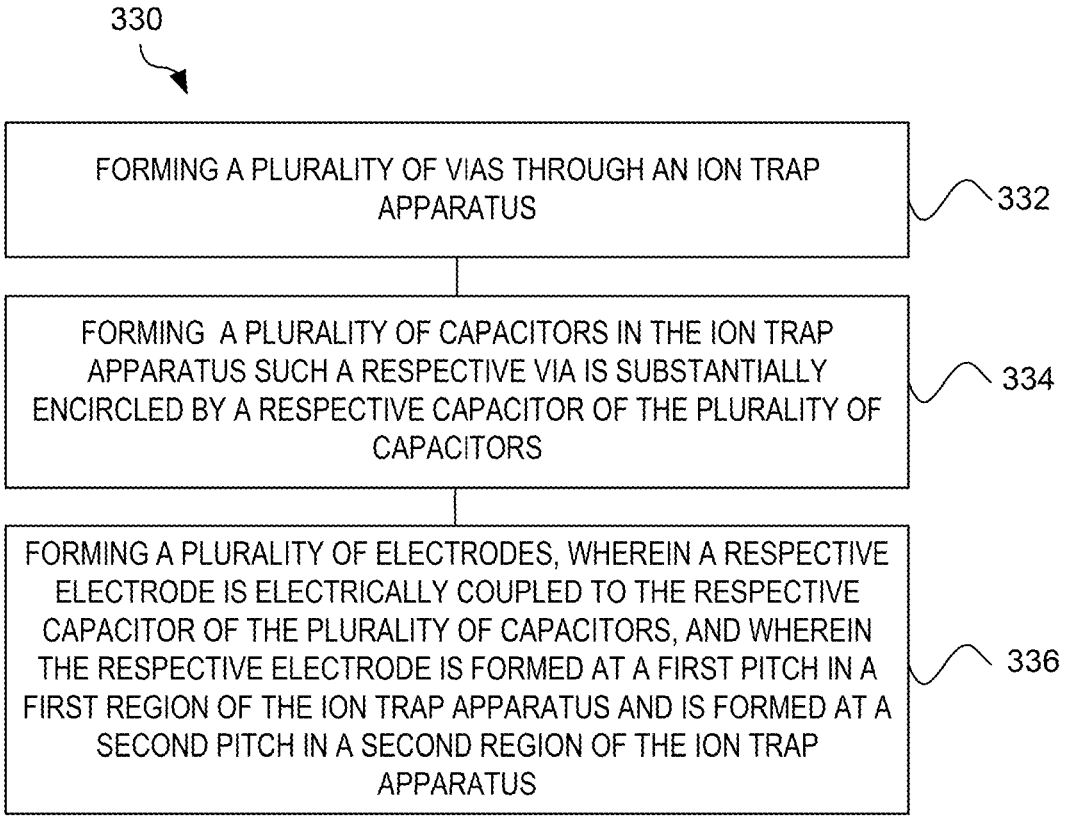
FIG. 3 illustrates an example flow chart of an example method for providing an ion trap with variable pitch electrodes.

FIG. 3 illustrates an example flow chart of an example method 330 for forming an ion trap with variable pitch electrodes. In this embodiment, the process can include forming a plurality of vias through an ion trap apparatus, at block 332. For example, in the embodiment of FIG. 2, the ion trap includes a plurality of vias 209 that can be formed through the substrate.

At block 334, the method 330 includes forming a plurality of capacitors in the ion trap apparatus such that a respective via (e.g., 209) is substantially encircled by a respective capacitor (e.g., 210-1) of the plurality of capacitors 210. In some embodiments at least one of the capacitors can be a trench capacitor.

In various embodiments, the method 330 can include forming a plurality of electrodes, wherein a respective electrode is electrically coupled to the respective capacitor of the plurality of capacitors, and wherein the respective electrode is formed at a first pitch in a first region of the ion trap apparatus and is formed at a second pitch in a second region of the ion trap apparatus. In some embodiments, a pitch associated with a respective electrode can taper from the first pitch to the second pitch such that a distance between the rails of the electrodes changes as a distance from a respective capacitor changes.

The method 330 can also include forming at least one of the plurality of capacitors to a depth between 250 and 350 microns below a surface of the ion trap apparatus. In some embodiments, the method can include filling a trench region of at least one of the plurality of capacitors with a doped polysilicon material. For example, the sidewalls of at least one of the plurality of capacitors can be oxidized and subsequently filled with a polysilicon. In some embodiments, the polysilicon can be a boron-doped polysilicon, for example $1.0\times10^{25}$ $m^{-3}$ boron-doped polysilicon.

In some embodiments, the method 330 can include forming the plurality of electrodes out of a metal, e.g., gold or other suitable metal. The electrodes can be formed such that a width of a respective rail of an electrode is between 1 micron and 2 microns.

The method 330 can include controlling a position of an ion in the ion trap with a first level of positional control in the first region of the trap, and controlling the position of an ion in the ion trap with a second level of positional control in the second region of the trap. In some embodiments, the first level of positional control and the second level of positional control can be different. For example, a comparatively coarse level of positional control over the ion can be provided in the first region of the trap and a comparatively fine level of positional control over the ion can be provided in the second region of the trap.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. In the foregoing Detailed Description, various features are grouped together in example embodiments illustrated in the figures for the purpose of streamlining the disclosure. Rather, inventive subject matter lies in less than all features of a single disclosed embodiment.

What is claimed:

1. An apparatus, comprising:

an ion trap; and a plurality of variable pitch electrodes disposed in the ion trap, wherein a respective electrode of the plurality of electrodes has a first pitch in a first region, and a second pitch in a second region, and wherein a pair of rails of the respective electrode of the plurality of electrodes taper from the first pitch to the second pitch.

2. The apparatus of claim 1, comprising a plurality of capacitors disposed in the first region, wherein a respective capacitor of the plurality of capacitors is formed on the first pitch.

3. The apparatus of claim 2, wherein the capacitors are trench capacitors.

4. The apparatus of claim 1, wherein the first pitch is between 50 microns and 70 microns.

5. The apparatus of claim 1, wherein the second pitch is less than 50 microns.

6. The apparatus of claim 1, wherein the second pitch is greater than 70 microns.

7. A method, comprising:

forming a plurality of vias at least through a substrate associated with an ion trap apparatus;

forming a plurality of capacitors in the ion trap apparatus such that a respective via is substantially encircled by a respective capacitor of the plurality of capacitors; and forming a plurality of electrodes in the ion trap apparatus, wherein a respective electrode is electrically coupled to the respective capacitor of the plurality of capacitors, and wherein the respective electrode is formed at a first pitch in a first region of the ion trap and is formed at a second pitch in a second region of the ion trap, and wherein a pair of rails of the respective electrode taper from the first pitch to the second pitch.

8. The method of claim 7, comprising forming at least one of the plurality of capacitors to a depth between 250 and 350 microns below a surface of the ion trap apparatus.

9. The method of claim 7, comprising filling a trench region of at least one of the plurality of capacitors with a polysilicon material.

10. The method of claim 9, wherein the polysilicon material is doped with boron.

11. The method of claim 7, comprising forming the plurality of electrodes out of gold, wherein a width of a respective electrode rail is between 1 micron and 2 microns.

12. An apparatus, comprising:

an apparatus body;

a plurality of vias disposed on the body;

a plurality of trench capacitors disposed on the body; and a plurality of electrodes, each respective electrode electrically coupled to a respective capacitor, wherein a first pitch of each respective electrode is the same as a pitch of the respective capacitor in a first region of the body, and a second pitch of each respective electrode is different than the pitch of the respective capacitor in a second region of the body, and wherein a pair of rails of each respective electrode taper from the first pitch of each respective electrode to the second pitch of each respective electrode.

13. The apparatus of claim 12, wherein each respective capacitor of the plurality of capacitors radially encompasses a respective via of the plurality of vias.

14. The apparatus of claim 12, wherein the pitch of the respective electrode is tapered from the first pitch to the second pitch such that a distance between rails of the respective electrode changes as a distance from the respective capacitor changes.

15. The apparatus of claim 12, wherein at least one of the plurality of capacitors has a capacitance between 90 and 110 picofarads.

16. The apparatus of claim 12, wherein the first pitch is between 50 and 70 microns and the second pitch is less than 50 microns.

* * * * *